US012508646B2

(12) United States Patent
Hrabina

(10) Patent No.: US 12,508,646 B2
(45) Date of Patent: Dec. 30, 2025

(54) MOULD FOR CASTING MOLTEN METAL COMPRISING A COUPLING MECHANISM FOR A SHROUD, CASTING INSTALLATION FOR CASTING A MOLTEN METAL AND METHOD FOR CASTING A MOLTEN METAL

(71) Applicant: Foseco International Limited, Derbyshire (GB)

(72) Inventor: David Hrabina, Derbyshire (GB)

(73) Assignee: Foseco International Limited, Derbyshire (GB)

( * ) Notice: Subject to any disclaimer, the term of this patent is extended or adjusted under 35 U.S.C. 154(b) by 0 days.

(21) Appl. No.: 18/681,660

(22) PCT Filed: Aug. 4, 2022

(86) PCT No.: PCT/EP2022/072007
§ 371 (c)(1),
(2) Date: Feb. 6, 2024

(87) PCT Pub. No.: WO2023/016927
PCT Pub. Date: Feb. 16, 2023

(65) Prior Publication Data

US 2024/0316621 A1 Sep. 26, 2024

(30) Foreign Application Priority Data

Aug. 11, 2021 (EP) ..... 21190734
Aug. 11, 2021 (EP) ..... 21190735

(51) Int. Cl.
*B22C 9/08* (2006.01)
*B22D 41/50* (2006.01)

(52) U.S. Cl.
CPC ..... *B22C 9/08* (2013.01); *B22D 41/50* (2013.01)

(58) Field of Classification Search
CPC ..... B22C 9/08; B22C 9/082; B22C 9/086; B22D 35/04; B22D 41/50; B22D 41/56
(Continued)

(56) References Cited

U.S. PATENT DOCUMENTS 6,138,742 A 10/2000 Billau
11,235,377 B2 2/2022 Hrabina
(Continued)

FOREIGN PATENT DOCUMENTS

SU 82453 A1 11/1949
SU 638424 A1 5/1978
(Continued)

OTHER PUBLICATIONS

Int'l Search Report for PCT/EP2022/072007, dated Oct. 7, 2022.
Office Action issued in corresponding Russian Appln. No. 2024101719/05(003439), dated Nov. 29, 2024.

*Primary Examiner* — Kevin P Kerns
(74) *Attorney, Agent, or Firm* — MaxGoLaw PLLC

(57) ABSTRACT

A mould for casting molten metals is provided that includes a mould/shroud coupling mechanism for a shroud of a casting installation. A funnel is provided that is attached to a hollow shaft, the mould/shroud coupling mechanism includes a seat member for receiving the funnel and holding the shroud and a base member fixed to the upper surface of the mould and coupled to the seat member by at least one compliant element such that the seat member is separated from and movable relative to the base member upon application of a load onto the seat member which deforms the at least one compliant element.

4 Claims, 12 Drawing Sheets

(58) Field of Classification Search
USPC ..... 164/47, 271, 349, 358
See application file for complete search history.

(56) References Cited

U.S. PATENT DOCUMENTS

| | | | | |
|---|---|---|---|---|
| 2002/0124987 | A1 | 9/2002 | Soderstrom et al. | |
| 2019/0168290 | A1* | 6/2019 | Hrabina ..... | B22D 35/04 |

FOREIGN PATENT DOCUMENTS

| | | | | |
|---|---|---|---|---|
| SU | 829332 | A2 | 5/1981 | |
| SU | 899267 | A1 | 1/1982 | |
| WO | 1998008636 | A1 | 3/1998 | |
| WO | WO 2015/055569 | A1 * | 4/2015 ..... | B22D 41/50 |

* cited by examiner

MOULD FOR CASTING MOLTEN METAL COMPRISING A COUPLING MECHANISM FOR A SHROUD, CASTING INSTALLATION FOR CASTING A MOLTEN METAL AND METHOD FOR CASTING A MOLTEN METAL

CROSS-REFERENCE TO RELATED APPLICATIONS

This application is the National Stage application of International Application No. PCT/EP2022/072007, filed Aug. 4, 2022, which claims the benefit of application Ser. Nos. 21/190,734.0 and 21190735.7, both filed Aug. 11, 2021.

TECHNICAL FIELD

The current invention refers to a mould comprising a mould/shroud coupling mechanism for a shroud of a casting installation. It also concerns a mould assembly and a casting installation for casting a molten metal comprising the mould/shroud coupling mechanism, and to a method of casting molten metals. The mould/shroud coupling mechanism of the present invention allows to automatically and smoothly form a sealing contact between a nozzle of a ladle and a shroud, without the intervention of a human operator or of a robot.

BACKGROUND OF THE INVENTION

One of the main challenges of metal casting processes is avoiding the entrainment of air during casting. This can lead to defects, including air bubbles and oxide films, which result in cracks in the casting. To avoid entrainment of air it is known in the art to cast the molten metal with the aid of a shroud which reduces re-oxidation of the metal upon pouring it between the ladle and the mould. As shown in FIG. 6, the shroud (10) is for example a hollow elongated shaft having a funnel on its proximal end (=inlet) and is inserted in a bore of the mould with its distal end (=outlet) communicating with a running system of the mould for example located below a casting cavity. A critical step, when coupling the nozzle (12) of a ladle to the shroud inlet at the level of the funnel, is to form a sealing contact between the two and to maintain the sealing contact during a whole duration of the casting operation.

A system for casting molten metals is disclosed in European patent application EP 3 463 715 B1. This system includes,

- a mould comprising a casting cavity having an inlet and a bore extending between an upper surface of the mould and the inlet,
- a shroud comprising a funnel and a hollow shaft, wherein the funnel is located outside of the mould adjacent to the upper surface, and the hollow shaft is housed in the bore and is movable therein.

To form a sealing contact between the nozzle and the funnel of shroud, EP 3 463 715 B1 proposes a lifting mechanism located at the upper surface of the mould. The lifting mechanism comprises concentrically arranged first and second collars, wherein the first collar is fixed to the upper surface of the mould and the second collar is rotatably coupled to the upper surface of the mould and supports the funnel of the shroud. A bayonet system comprising a follower engaged in a ramped slot allows the second collar to be lifted relative to the upper surface of the mould by rotation, thus causing a linear motion of the shroud. The rotation of the bayonet system is carried out by an operator, who must dose the angle of rotation of the bayonet to lift the funnel sufficiently to form a sealing contact, without damaging the refractory materials in contact. The operator necessarily must be in the vicinity of the nozzle of the ladle which is from a security perspective not ideal. Moreover, one operator is required for centring and aligning the ladle nozzle above the funnel and another operator is required to operate the lifting mechanism via the handle. Once the funnel of the shroud is in contact with the nozzle, the lifting mechanism does not move anymore during the whole duration of the casting operation. This can be a problem, since the flow of molten metal through the shroud causes vibrations which propagate to the contact area between the nozzle and the funnel, which can cause wear or even cracks in the refractory materials.

It is an object of the current invention to provide a mould comprising a mould/shroud coupling mechanism which is easy to operate, and which requires less human interventions for engaging a funnel of a shroud with the nozzle of a ladle to form a sealing contact. Moreover, it is an object of the current invention to provide a casting installation which is easier and safer to operate than the systems known in the prior art.

A further object of the current invention is to provide a method of casting molten metals with the mould/shroud coupling mechanism of the above referred kind.

SUMMARY OF THE INVENTION

These and other objects are achieved by the features of the independent claims.

Preferred embodiments of the invention are covered by the dependent claims.

In a first aspect, the invention concerns a mould for casting molten metals, comprising: a casting cavity having a cavity inlet,

- a housing selected among a filter housing and a diverter housing, having a housing outlet in fluid communication with the cavity inlet and a housing inlet in fluid communication with,
- a bore extending between an upper surface of the mould and the housing inlet,
- a mould/shroud coupling mechanism configured for accommodating a shroud of a casting installation in a shroud casting position, wherein the shroud comprises a funnel attached to a proximal end of a shaft which is hollow and having a distal end comprising a shroud outlet, and wherein the shroud casting position is defined as the shaft being accommodated in the bore with the distal end thereof inserted through the housing inlet with the shroud outlet enclosed in the housing.

The mould is characterized in that the mould/shroud coupling mechanism comprises:

- a base member fixed to the upper surface,
- a seat member configured for receiving the funnel and holding the shroud in the shroud casting position.

The seat member is coupled to the base member by at least one compliant element such that the seat member is separated from and movable relative to the base member upon application of a load onto the seat member which deforms the at least one compliant element.

The compliant element can comprise one or more resilient elements defining a resilient configuration. The one or more resilient elements can include an elastomeric material at a process temperature or a spring, preferably a spiral spring, extending between the seat member and the base member. Alternatively, the compliant elements can comprise a free-flowing material enclosed in one or more bags configured for deforming upon application of the load onto the seat member.

In a preferred embodiment, the base member and seat member each comprises a central hole aligned with one another to define a lead in towards the bore for the shroud. In the resilient configuration as defined supra the mould/shroud coupling mechanism can comprise at least three resilient elements, preferably at least three spiral springs, extending between the seat member and the base member, wherein the at least three resilient elements are preferably equally spaced apart around a circumference of the central holes of the seat member and the base member.

In a second aspect, the invention concerns a mould assembly comprising:

a mould according to the invention, and a shroud comprising a funnel attached to a proximal end of a shaft which is hollow and having a distal end comprising a shroud outlet, the shroud being accommodated in the mould with the seat member receiving the funnel and holding the shroud in the shroud casting position, wherein the shroud casting position is defined as the shaft being accommodated in the bore with the distal end thereof inserted through the housing inlet with the shroud outlet enclosed in the housing.

In a preferred embodiment of the mould assembly, the shroud is fixed to the seat member with a filling of moulding sand sealing an annular gap between the funnel and the seat member and defining a seat for the funnel, and the seat member preferably comprises a sleeve defining a boundary of the annular gap.

In a third aspect, the invention concerns a casting installation comprising, a mould according to the invention, and a shroud comprising a funnel attached to a proximal end of a shaft which is hollow and having a distal end comprising a shroud outlet, a ladle comprising a nozzle provided at a base of the ladle for dispensing molten metal out of the ladle, wherein the nozzle is configured for reversibly and sealingly engaging into the funnel of the shroud, and wherein the ladle is configured for being displaced relative to the mould, such as:

to position the nozzle substantially vertically above the mould/shroud coupling mechanism and to be lowered vertically until the nozzle is sealingly engaged in the funnel of the shroud in the shroud casting position by applying the load onto the seat member, wherein the shroud casting position is defined as the shaft being accommodated in the bore with the distal end thereof inserted through the housing inlet with the shroud outlet enclosed in the housing.

In a gripping-configuration of the casting installation according to the invention, the casting installation comprises a ladle/shroud coupling mechanism configured for reversibly gripping the shroud to the nozzle, preferably without forming a seal between the funnel and the nozzle, wherein the ladle/shroud coupling mechanism comprises, a funnel adapter, fixed to the funnel of the shroud, the funnel adapter comprising holding means, and a nozzle adapter, fixed to the base of the ladle or to the nozzle, and configured for engaging the holding means of the funnel adapter to reversibly lock the shroud to the nozzle in a locked position.

In preferred embodiments of the gripping-configuration of the casting installation:

the holding means of the funnel adapter comprises holding pegs, and the nozzle adapter comprises fastening hooks configured for reversibly engaging the holding pegs and preferably configured to be self-engaging with the holding pegs, or the holding means of the funnel adapter comprises one or more holding pegs, and the nozzle adapter comprises a bayonet coupling element configured for interacting with the one or more holding pegs to reversibly lock the shroud to the nozzle in the locked position.

In a preferred embodiment of the gripping-configuration of the casting installation, the funnel adapter is fixed to the shroud with an adhesive material.

In a preferred embodiment of the gripping-configuration, the seat member of the mould/shroud coupling mechanism is configured for receiving the funnel adapter and holding the shroud in the shroud casting position. In a preferred embodiment of the gripping configuration, the seat member comprises a conical portion centred on the central hole of the seat member. The conical portion is configured for guiding the shroud in alignment with the bore as the ladle is lowered vertically with the shroud reversibly locked to the nozzle.

In a fourth aspect, the invention concerns a method for casting a molten metal with the casting installation according to the invention, comprising:

lowering the ladle vertically until the nozzle engaged in the funnel applies a load onto the funnel sitting on the seat member, thus moving the seat member relative to the base member against the compliant elements, and forming a sealing contact between the nozzle and the shroud in the shroud casting position, allowing the molten metal to flow from the ladle to the casting cavity through the nozzle, the shroud, and the housing.

In one embodiment of the method wherein the casting installation comprises the mould assembly according to the invention, the method comprises engaging the nozzle into the funnel by lowering vertically the ladle and forming the sealing contact between the nozzle and the shroud by further lowering the ladle for the nozzle to apply the load onto the funnel.

In another embodiment of the method applied to the gripping configuration of the casting installation, the method comprises:

engaging the nozzle in the funnel of the shroud and gripping the shroud to the nozzle with the ladle/shroud coupling mechanism by engaging:

the holding means of the funnel adapter fixed to the funnel of the shroud with, the nozzle adapter fixed to the base of the ladle or to the nozzle, such as to lock the shroud to the nozzle in a locked position, positioning the shroud locked to the nozzle substantially vertically above the mould/shroud coupling mechanism, lowering vertically until the shroud reaches the shroud casting position with the funnel resting on the seat member, forming the sealing contact between the nozzle and the shroud by further lowering the ladle for the nozzle to apply the load onto the funnel.

BRIEF DESCRIPTION OF THE FIGURES

Preferred embodiments of the invention will hereinafter be explained in detail with reference to the accompanying drawings.

In the drawings.

DETAILED DESCRIPTION OF THE INVENTION

Figure 5:
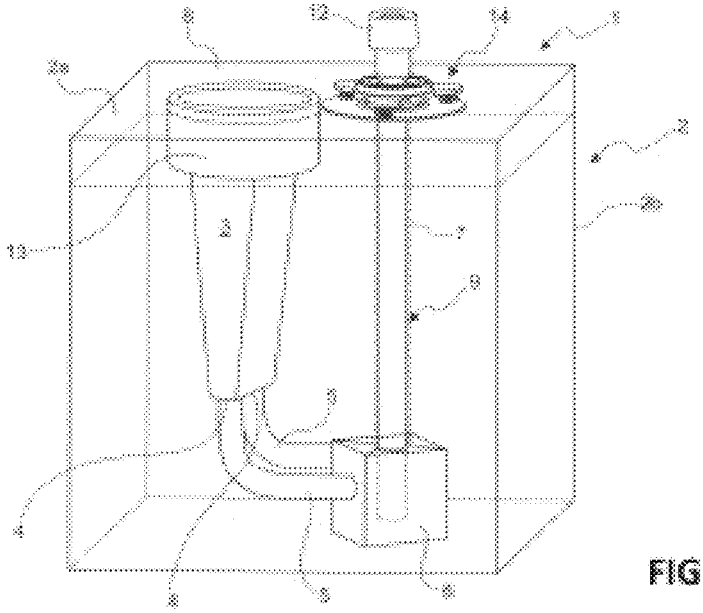
FIG. 5 shows a perspective view of the casting installation according to the invention, wherein the nozzle of the ladle is located vertically above the funnel of the shroud in the shroud casting position, wherein the funnel is received in the seat member of the mould/shroud coupling mechanism. The ladle is not represented for sake of clarity.

In a first aspect, the invention concerns a mould (2) for casting molten metals as shown in FIG. 5. The mould (2) comprises one or more casting cavities (3) each having one or more cavity inlets (4), and a housing (6) selected among a filter housing and a diverter housing. The housing (6) comprises one or more housing outlets (60) in fluid communication with the one or more cavity inlets (4) of the one or more casting cavities (3). The housing (6) also comprises a housing inlet (6*i*) in fluid communication with a bore (7) extending vertically between the housing inlet (6*i*) and an upper surface (8) of the mould where it opens in an opening. At least a portion of the upper surface (8) surrounding the opening is preferably substantially planar and preferably horizontal.

In FIG. 5, the mould (2) comprises an upper part (2*a*) and a lower part (2*b*) joined horizontally at a parting line, and a single casting cavity (3). The casting cavity (3) is bottom fed via two cavity inlets (4). The cavity inlets (4) communicate with two feeding channels (5) to a housing (6) which is connected to the bore (7) extending to the upper surface (8) of the mould (2). The housing (6) can be a filter housing or a diverter housing. The filter housing may be designed in the same way or in a similar way as the one disclosed in EP 3 463 715 B1, which insofar is incorporated herein by reference.

Figure 15:
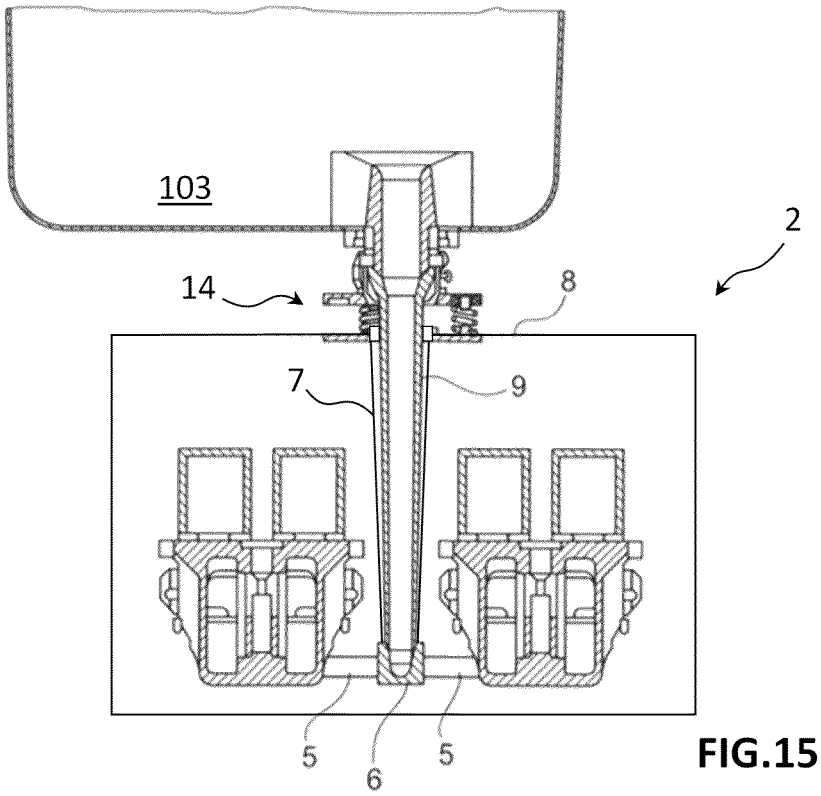
FIG. 15 shows a detailed cross-sectional view of the casting installation comprising the ladle/shroud coupling mechanism according to the invention, with the shroud gripped to the nozzle and in the shroud casting position.
Figure 16:
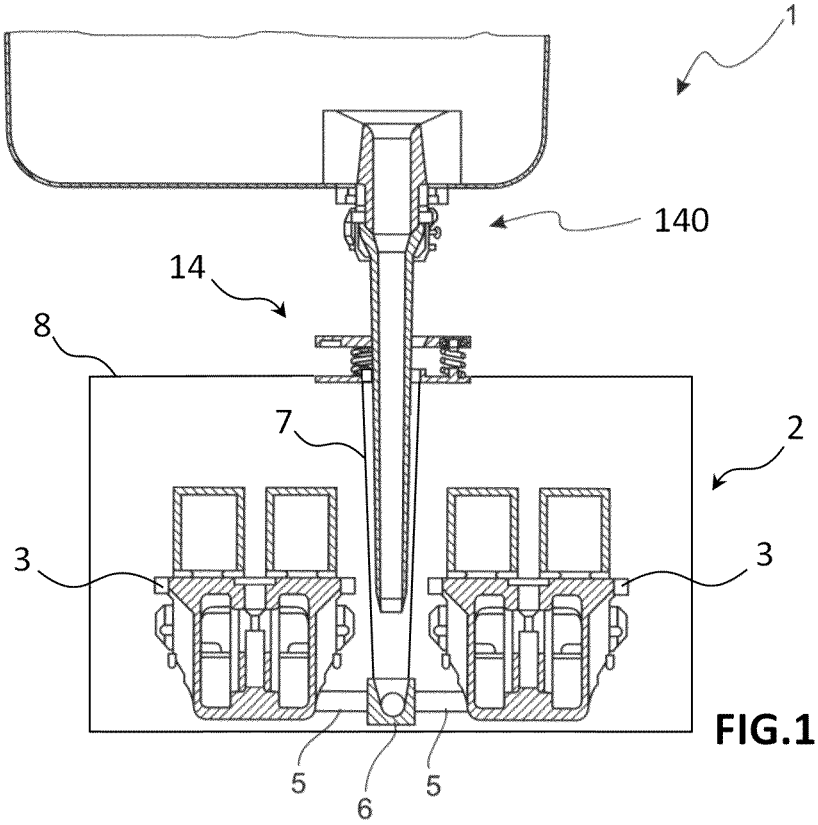
FIG. 16 shows a detailed cross-sectional view of the casting installation of FIG. 15, wherein the shroud is gripped to the nozzle and translated (up or down) vertically above the mould.

In FIGS. 15 and 16, the mould (2) comprises several casting cavities each in fluid communication with the housing (6) via respective feeding channels (5) for conveying the molten metal from the housing to the casting cavities. Similarly, a same mould can comprise two or more bores (7) in fluid communication with one or more corresponding housings (6).

The housing (6) of the mould (2) according to the invention comprises a single housing inlet (6*i*) and a single or a plurality of housing outlets (60). It is configured for distributing the flow of the molten metal traversing the housing from the housing inlet (6*i*) to the one or more housing outlets (60) connected to the casting cavities. The housing (6) is selected among a diverter housing and a filter housing comprising a filter element for filtering and eliminating impurities in the flow of molten metal.

Mould/Shroud Coupling Mechanism (14)

Figure 3:
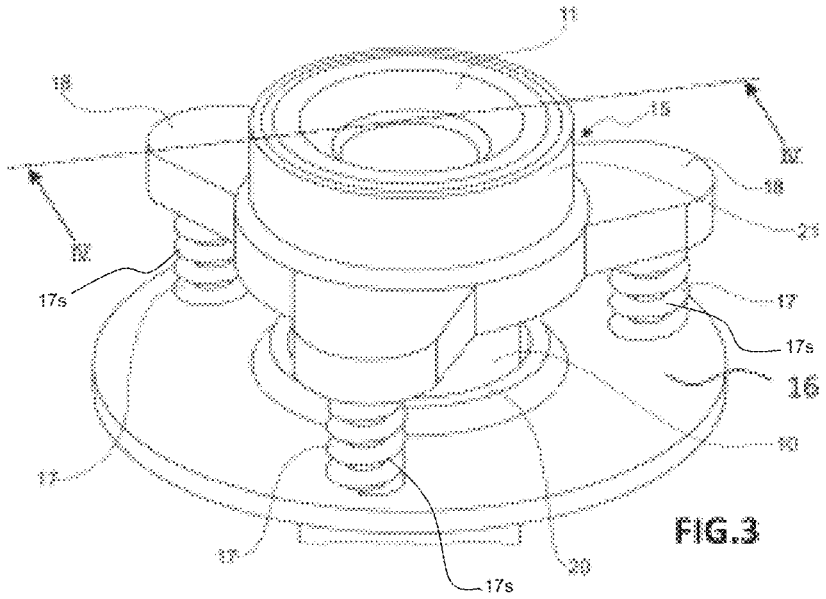
FIG. 3 shows a perspective view of an embodiment of the mould/shroud coupling mechanism according to the invention supporting a shroud accommodated therein.
Figure 6:
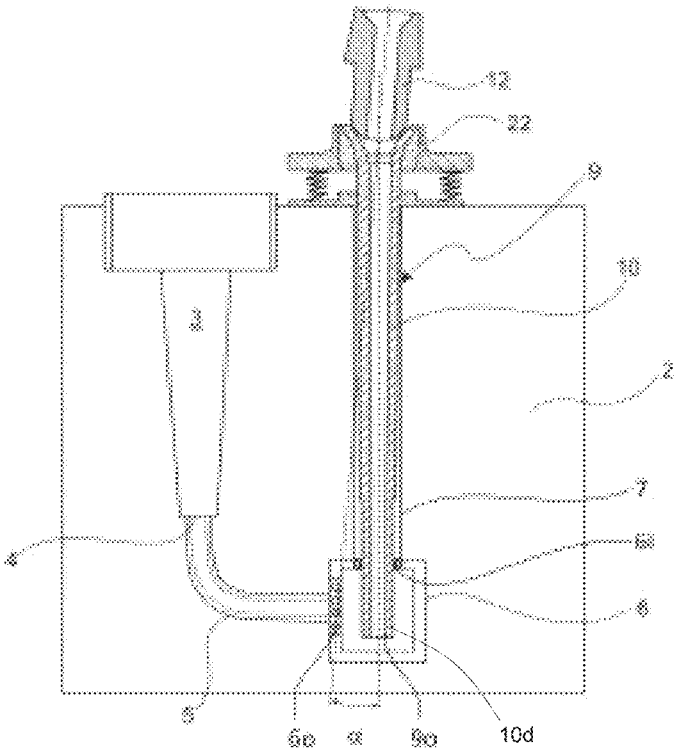
FIG. 6 shows a cross-sectional view of the casting installation in FIG. 5, wherein the nozzle is reversibly and sealingly engaging into the funnel of the shroud.

During a casting, the molten metal contained in a ladle (103) is dispensed through a nozzle (12) located in a lower portion of the ladle (103), whence it flows into the cavities (3) through shroud (9), the housing (6), and the feeding channels (5). The shroud (9) comprises a funnel (11) attached to a proximal end of a shaft (10) which is hollow with a shroud bore opening a shroud inlet in the funnel and extending to a shroud outlet (9*o*) opening at a distal end (10*d*) of the hollow shaft. For maintaining a position of the shroud during the duration of a casting operation, the mould according to the invention comprises a mould/shroud coupling mechanism (14), an embodiment of which is shown in FIG. 3. As shown in FIG. 6, the mould/shroud coupling mechanism (14) is configured for accommodating the shroud (9) of a casting installation (1) in a shroud casting position defined as the shaft (10) being accommodated in the bore (7) with the distal end (10*d*) thereof inserted in the housing (6) through the housing inlet (6*i*) such that the shroud outlet (9*o*) is enclosed in the housing (6). During a casting operation, the molten metal flows out of the ladle through the nozzle (12) sealingly engaged in the funnel (11) of the shroud (9) in the shroud casting position. The molten metal flows through the shaft (10) and enters into the housing (6) via the shroud outlet (9*o*) enclosed therein, and out into the feeding channels through the housing outlet (60) and fills the casting cavities.

As shown in FIG. 6, the mould (2) according to the invention is characterized in that the mould/shroud coupling mechanism (14) comprises a base member (16) fixed to the upper surface (8), and a seat member (15) configured for receiving the funnel (11) and holding the shroud (9) in the shroud casting position. As shown in FIG. 3, the seat member (15) is coupled to the base member (16) by at least one compliant element (17) such that the seat member (15) is separated from the base member (16) when the mould/shroud coupling mechanism (14) is in a rest state, and movable relative to the base member (16) and preferably towards the base member (16) upon application of a load onto the seat member (15) which deforms the at least one compliant element (17).

Figure 7A:
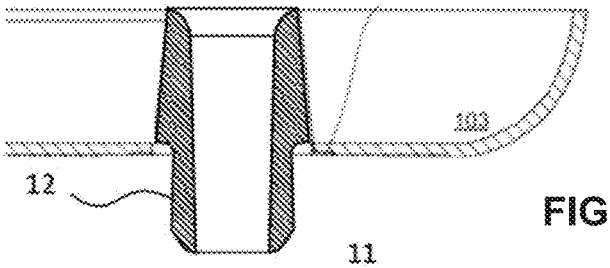
FIG. 7A-7C show detailed cross-sectional views of the mould/shroud coupling mechanism and the nozzle in a casting installation according to the invention, FIG. 7A as the ladle moves above the mould, aligning the nozzle with the funnel, FIG. 7B as the ladle is lowered to bring the nozzle close to or in contact with the funnel, and FIG. 7C as the ladle is further lowered to press the compliant elements to form a sealing contact.
Figure 7B:
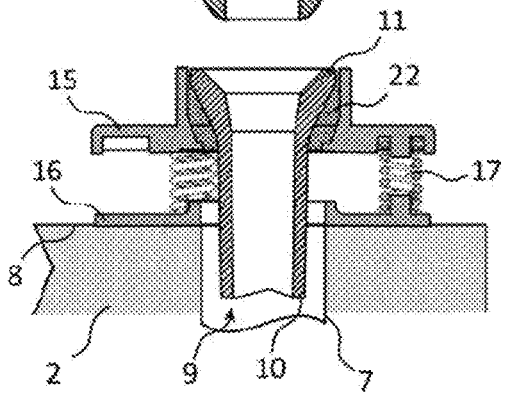
Figure 7B:
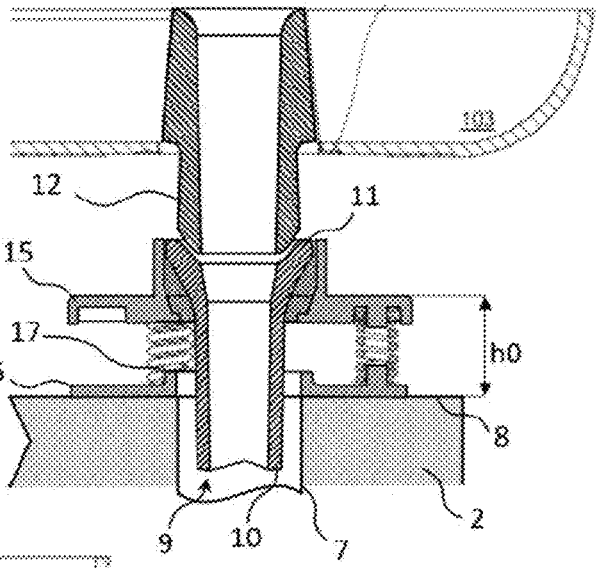
Figure 7C:
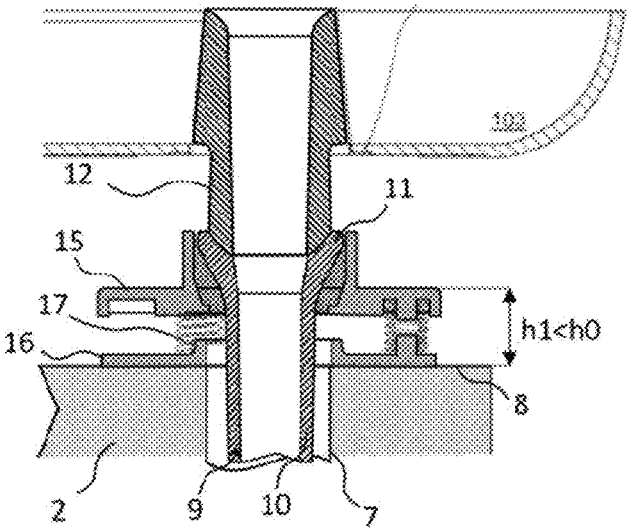

With the mould/shroud coupling mechanism (14) of the invention it is not necessary to manually lift the shroud (9) received in the seat member (15) in order to engage the funnel (11) with the nozzle (12) of the ladle (103). In one embodiment of the present invention, the shroud is coupled to the mould in the casting position, i.e., with the funnel resting on the seat member (15) of the mould/shroud coupling mechanism (14), with the hollow shaft housed in the bore (7), and the shroud outlet (9*o*) in the housing (6). Contrary to the mould/shroud coupling mechanism described in EP 3 463 715 B1, at the rest state, the funnel is resting on the seat member (15) which is maintained at a rest distance (h0) from the base member (16) by the reaction force of the so biased compliant element (17). The nozzle (12) of the ladle (103) is engaged with the funnel (11) resting on the seat member (15) of the mould/shroud coupling mechanism (14) simply by first moving the ladle above the mould, vis-à-vis the funnel and subsequently lowering the ladle (103) towards the mould (2) until the nozzle engages the funnel, as illustrated in FIGS. 7A and 7B. In FIG. 7A, the nozzle is aligned with and located at a distance from the funnel along the vertical direction. Then, the ladle is lowered i.e., moved downwardly towards the funnel such that the nozzle engages in the funnel of the shroud, as illustrated in FIG. 7B. At this stage, the nozzle and the funnel are not coupled so as to form a sealing contact. To sealingly engage the nozzle into the funnel and prevent air and molten metal from leaking through the interface between the nozzle and the funnel, the ladle is then further lowered as illustrated in FIG. 7C, such that the nozzle contacts and applies a load on the funnel resting on the seat member (15) of the mould/shroud coupling mechanism (14), causing the seat member (15) to move towards the base member (16) by deforming the compliant element (17) so that the coupling of the nozzle and the funnel can be performed in a controlled fashion. As shown in FIG. 7C, the movement of the seat member (15) relative to the base member (16) driven by the downward translation of the ladle and rendered possible by the deformation of the compliant member (17) reduces the distance between the seat members (15) and the base member (16) from the rest distance (h0) to a sealed distance (h1), with h1<h0. The downward movement of the seat member towards the base member will of course cause the shroud to move axially in the bore of the mould. This means that, because the downward movement of the seat member (15) towards the base member (16) drives the distal end of the shroud and the shroud outlet (9*o*) deeper into the housing, the housing inlet (6*i*) must allow such movement. Besides means known in the art, dynamic seal between the moving shroud and a static housing inlet (6*i*) can be formed using an intumescent sealing material, e.g. a gasket lodged in the housing inlet, as described for sliding gates in WO 2013/088249 A2.

In FIGS. 7A and 7B, the nozzle is not or barely in contact with the funnel. Therefore, the mould/shroud coupling mechanism (14) is in the rest state wherein the seat member (15) is maintained at a fixed rest distance (h0) from the base member (16), as it is supported by the compliant element (17) which is also at a rest state against the gravity force In FIG. 7C, the mould/shroud coupling mechanism (14) is in a loaded state wherein the nozzle is in contact with the funnel and applies a load thereon i.e., a downwardly oriented force, driven by the downward movement of the ladle. This load applied onto the funnel is transmitted via the seat member to the compliant element (17), which deforms to reach a deformed or loaded state wherein the seat member (15) moves to a sealed distance (h1) from the base member (16). The reaction force of the compliant element presses the funnel against the nozzle, thus forming a sealing contact at the interface between the nozzle and the funnel. The presence of the compliant element (17) in the invention replaces the intervention of an operator to manually rotate the bayonet and lift the funnel for engaging it with the nozzle as in the prior art. In the invention, lowering down the ladle for sealingly engaging the nozzle into the funnel of the shroud can be achieved by the operator commanding the position of the ladle. Furthermore, the action of an operator is not reproducible, and the force applied at the interface between the nozzle and the funnel depends on the force applied for rotating the bayonet. With the compliant member (17) the same force is applied at each casting operation as it is controlled by the compliance of the compliant member.

Another advantage brought by the mould/shroud coupling mechanism (14) in the mould of the invention is to allow displacements between the seat and base members, and thus between the shroud held by the seat member and the mould and to absorb energy generated by such movements, reducing wear caused by friction between moving elements. For example, lowering down the ladle along the vertical direction requires a high level of precision by the operator commanding the position of the ladle for avoiding shocks when engaging and contacting the nozzle with the funnel i.e., to establish the contact between the nozzle and the funnel softly. In absence of the compliant element, lowering down the ladle too far or too fast may induce important stress, shocks or even failure in a refractory material of the nozzle and funnel, especially at the contact point with the nozzle. The energy of such impact is partly absorbed in the present invention thanks to the presence of the mould/shroud coupling mechanism (14) allowing compliant relative displacement between the seat and base members.

The mould/shroud coupling mechanism (14) in the mould of the invention preferably allows for also compensating a lateral and/or a tilting misalignment between the nozzle and the funnel i.e., a misalignment between the nozzle and the funnel in a horizontal direction. Lateral misalignments can occur when lowering down the ladle for engaging the nozzle into the funnel of the shroud. Without compliant element (17) in the mould/shroud coupling mechanism (14) as is the case to date, a lateral misalignment can prevent the formation of a sealing contact between the nozzle and the funnel or may cause important material stresses to compensate this misalignment for establishing the sealing contact. In the present invention, lateral misalignment is compensated by the mould/shroud coupling mechanism (14) thanks to the introduction of the compliant element, thereby reducing material stresses and potential failures in the casting installation. The same applied in case of a tilting or angular misalignment (a) as illustrated in FIG. 6.

Similarly, the mould according to the invention comprising the mould/shroud coupling mechanism (14) also allows to compensate small displacements of the ladle with respect to the mould and to maintain the sealing contact between the nozzle and the funnel during the casting operation. For example, such displacements are due to molten metal flowing through the shroud bore and to changes in the distribution of the mass of the molten metal held in the ladle as the ladle is progressively emptied of molten metal during the casting operation, which causes the ladle to slightly tilt or move vertically or laterally, and the nozzle engaged in the funnel therewith as illustrated in FIG. 6.

Figure 4:
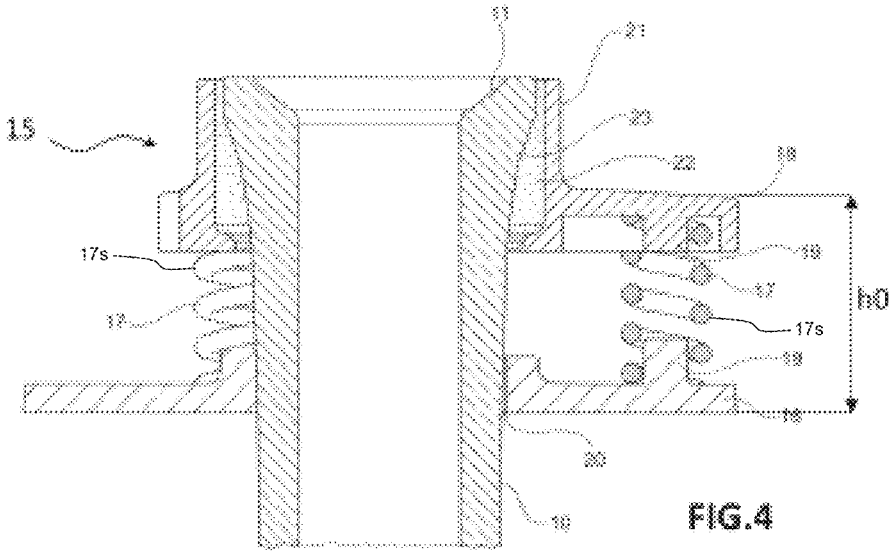
FIG. 4 shows a cross-section along the lines IV-IV in FIG. 3, of the mould/shroud coupling mechanism and of the shroud accommodated therein of FIG. 3.

As illustrated in FIGS. 3, 4 and 5, the base member (16) and seat member (15) of the mould/shroud coupling mechanism (14) according to the invention, can each comprise a central hole aligned with one another to define a lead-in towards the bore (7) for the shroud (9). In FIGS. 3, 4 and 5, the base member (16) has a central hole (20) which is circular and forms a lead-in to the bore (7) through which the shroud (9) can penetrate into the bore (7) until reaching the casting position i.e., when the funnel of the shroud rests on the seat member with the shroud outlet in the housing (6), as shown in FIG. 5 and in the detailed cross-sectional view of FIG. 4. As will be discussed below, the shroud can be introduced into the bore by a human operator, as shown in FIG. 1 (1*a*), or by lowering the ladle with the shroud attached thereto, shown in FIGS. 2 (1) and (2).

Figure 1:
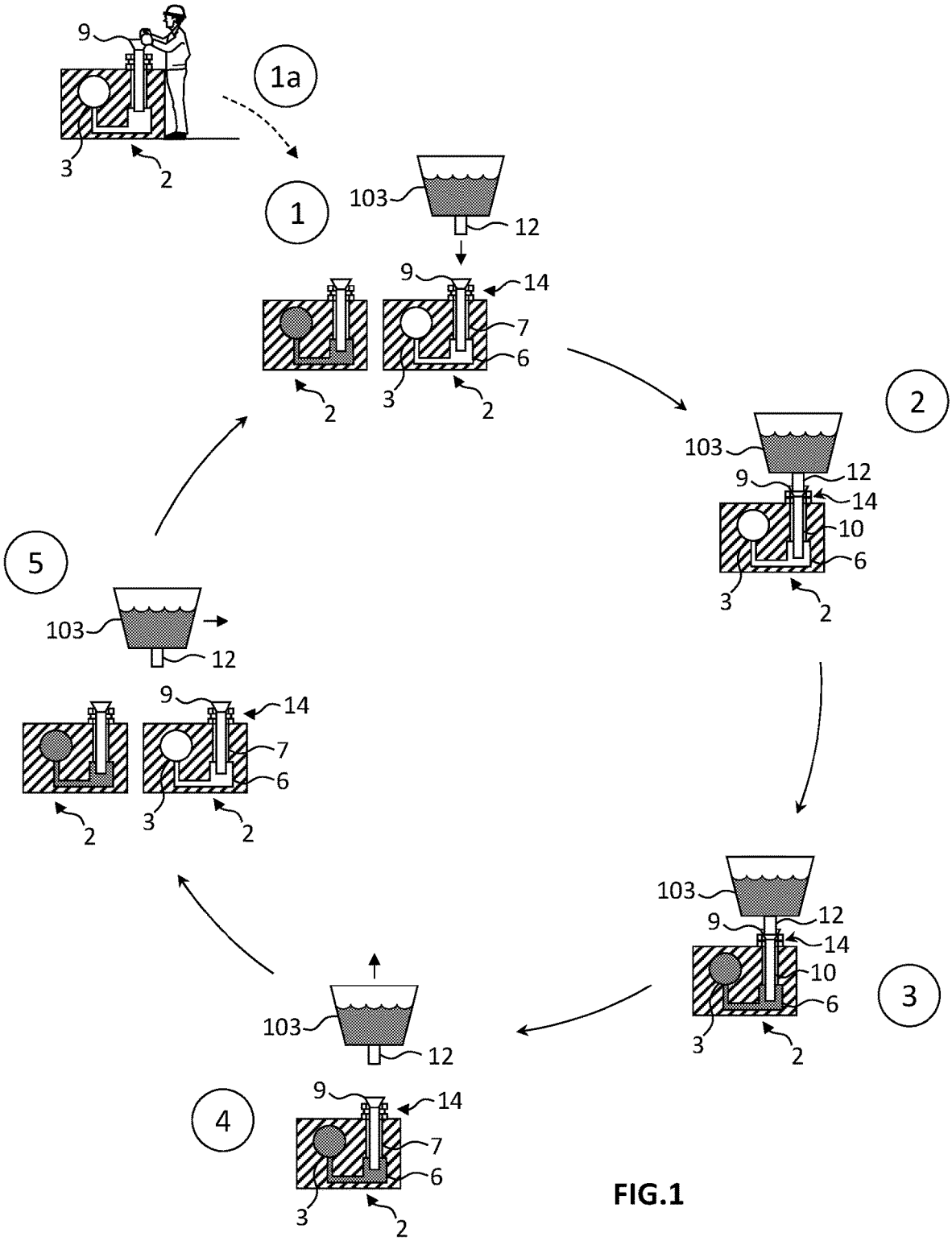
FIG. 1 shows steps of a metal casting method with the casting installation according to an embodiment of the invention.

In one embodiment, wherein the shroud is in the casting position before the ladle is lowered to establish contact between the nozzle and the funnel (cf. FIGS. 1 (1*a*)&(1), and 7A), the seat member (15) is formed by a sleeve (21) provided with arms (18) distributed about a circumference of the sleeve and extending radially outwards therefrom, as illustrated in FIGS. 3 and 4. The sleeve (21) forms a lead-through to guide the shroud (9) to the casting position. At the rest state, the sleeve is concentrically aligned with the central hole (20) of the base member (16). As shown in FIGS. 4 and 7A, to fix the funnel to the mould (2), a space between the lead-through of the sleeve and the funnel can be filled with a filling (22), preferably made of moulding sand, forming a seat on which a shoulder (23) of the funnel (11) rests when the shroud (9) is in the casting position.

The filling (22) of moulding sand may comprise an organic binder such as furan, alkaline-phenolic binders. Also, other binders, for example inorganic binders or clay minerals may be used. The filling defines a seat for a conical shoulder (23) of the funnel and at the same time provides a seal and fixes the shroud to the mould (2)

In the casting position of shroud, the funnel is preferably flush with an upper rim of the sleeve as illustrated in FIG. 4 or, alternatively, may be sunk in the sleeve (21) below the upper rim.

A preferred embodiment of the mould/shroud coupling mechanism (14) of the invention is represented in FIG. 3. It comprises a seat member (15) configured for receiving and holding the funnel (11). The seat member is coupled to the base member (16) by means of compliant members (17) in the form of spiral springs (17*s*). The seat member (15) has three radially outwardly extending arms (18) which are equally spaced apart from each other at a radial distance to an axis of symmetry of the drive-through. A person skilled in the art may appreciate that the seat member can have any other shape, for example can be disk shaped and the number of outwardly extending arms can vary.

The base member (16) is preferably rigidly fixed to the upper surface (8) of the mould (2). For examples, the base member can be coupled with an adhesive (organic or mineral), or with fastening means such as screws, rivets, and the like. This ensures that the central hole (20) of the base member remains concentric with the bore (7) during the whole casting operation. The base member also comprises three radially outwardly extending arms (18) which are equally spaced apart from each other at a radial distance to an axis of symmetry of the central hole (20), and aligned with the corresponding opposite arms of the seat member (15). The compliant element (17) is formed by three spiral springs (17*s*) sandwiched between the seat member and the base member.

Figure 8:
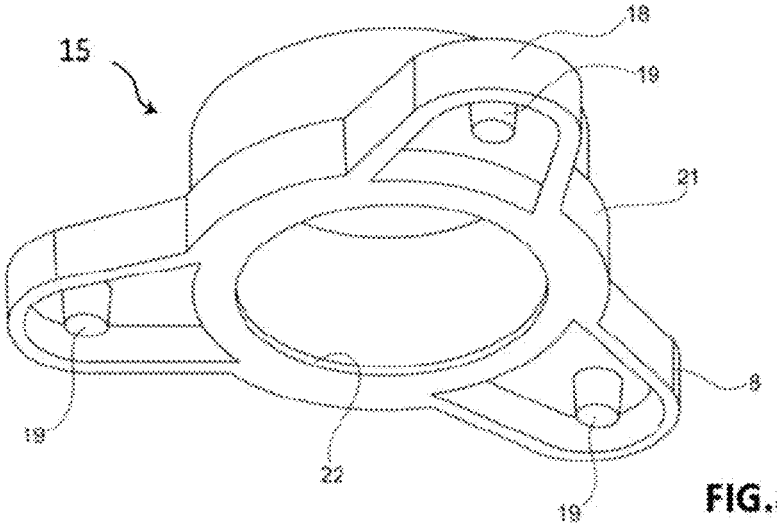
FIG. 8 shows a perspective bottom view of the seat member of the mould/shroud coupling mechanism according to an embodiment of the invention.

Referring to FIG. 3, the three spiral springs (17*s*) extend vertically between three pairs of opposite arms (18) of the seat member (15) and the base member (16). The spiral springs (17*s*) are equally distributed about the circumference of the seat member (15) and the base member (16). The arms (18) are provided with centring pins (19) for centring and retaining the spiral springs in place, as illustrated in the detailed view of FIGS. 4 and 8, The centring pins (19) of the seat member (15) and the centring pins (19) of the base member (16) extend in opposite directions and are aligned with each other so that one centring pin (19) of the base member (16) and the correspondingly arranged centring pin (19) of the seat member (15) each engages one end of a spiral spring (17*s*) on opposite sides. With this configuration, the seat member (15) is supported on the base member by three spiral springs (17*s*) in a movable fashion.

When the shroud (9) with the funnel (11) is in the casting position resting on the seat member (15) the spiral springs (17*s*) are at the rest state, so that there is a vertical rest distance (h0) between the seat member (15) and the base member (16) (cf. FIGS. 4 and 7B).

When the metal is to be cast into the casting cavity (3) the ladle is centred above the mould (2) such that the nozzle (12) of the ladle is aligned with the funnel (11). The ladle (103) which hangs on a crane is then lowered and the nozzle (12) engages the funnel (11) thereby exerting a downwardly directed force which vertically displaces the seat member (15) towards the base member (16). This vertical displacement is made possible by the deformation of the compliant elements (17) (here by the compression of the spiral springs).

Compliant Element (17)

In the mould according to the invention, the seat member (15) is coupled to the base member (16) by at least one compliant element (17) such that the seat member (15) is separated from and movable relative to the base member (16) upon application of a load onto the seat member (15) which deforms the at least one compliant element (17). In particular, upon application of the load or force applied vertically and downwardly as the ladle is lowered and the nozzle (12) presses onto the funnel (11) of the shroud received in the seat member (15), the compliant element (17) is configured for moving from a rest state as illustrated in FIG. 7B wherein a vertical rest distance (h0) separates the seat member (15) from the base member (16), to a loaded or deformed state as illustrated in FIG. 7C wherein the vertical distance separating the seat member (15) from the base member (16) decrease to a sealed distance (h1), wherein h1<h0. This means that the seat member (15) moves towards or closer to the base member (16) along the vertical direction upon application of the vertical and downward force by the nozzle onto the funnel of the shroud.

In addition, the compliant element (17) in the mould/shroud coupling mechanism (14) according to the invention can be configured for allowing lateral displacements of the seat member (15) relative to the base member (16) i.e., relative displacements between the seat and base members along a horizontal direction orthogonal to the vertical direction.

In the mould/shroud coupling mechanism (14) of the invention, the compliant element (17) can be at least partially resilient such that in the deformed or loaded state it opposes a reaction force tending to restore at least partially the rest state of the mould/shroud coupling mechanism (14). This includes compliant elements (17) showing an elastic behaviour (such as spiral springs (17*s*) made of steel), or a visco-elastic behaviour, with an elastic modulus (E') and a loss modulus (E"). For example, under application of the vertically and downwardly oriented load by the nozzle of the ladle onto the funnel received in the seat member, to drive the seat element (15) down to the sealed distance (d1) from the base element (16), the reaction force of the loaded compliant element (17) can tend, upon release of the load, to drive the seat element (15) at least partially towards the initial rest distance (d0) from the base element (i.e., to a distance h, such that h1<h≤h0). Such resilient element is preferred as it is suitable for maintaining a sealing contact between the funnel and nozzle during a casting also in the event of the nozzle moving slightly up and down due to vibrations during the casting. Generally speaking, the compliant element which is resilient is thus more suitable for uses in cases wherein the nozzle sealingly engaged in the funnel of the shroud moves or vibrates during the casting operation.

Alternatively, the compliant element (17) can show a purely plastic or viscous behaviour, such that upon release of a load, it is unable to recover, even partially, its original geometry. For example, this is the case of a compliant element configured for deforming substantially plastically upon application of a load. This can also be the case of flexible bags or vessels containing a free-flowing material, such as a particulate material (e.g., sand or the like), which can absorb energy be opposing a viscous flow to the load applied by the nozzle onto the shroud and seat element.

The mould/shroud coupling mechanism (14) can comprise one or more compliant elements (17) extending between the seat member (15) and the base member (16), and separating them from one another in the vertical direction. Preferably, the one or more compliant elements (17) comprise one or more resilient elements including an elastomeric material at a process temperature or a spring, preferably a spiral spring (17*s*) as illustrated in FIG. 3.

Figure 17A:
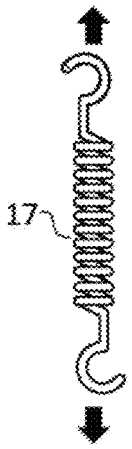
FIG. 17A-17E shows various embodiments of the compliant element in the invention.

In a first embodiment shown in FIG. 17A, the resilient element is configured for elongating when moving from the rest to the deformed or loaded state of the resilient element corresponding to the rest or loaded state of the mould/shroud coupling mechanism, respectively. This is referred to as a "tensile-resilient element". The tensile-resilient element is preferably an expandable spring as illustrated in FIG. 17A.

Figure 17B:
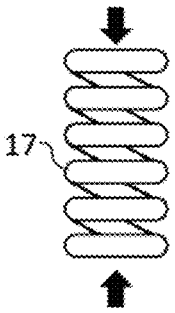
Figure 17C:
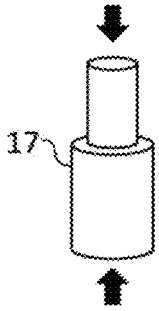
Figure 17D:
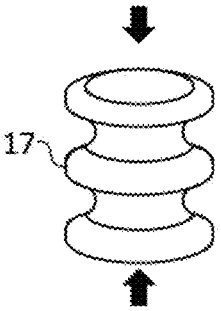

In a second embodiment shown in FIGS. 17B through 17D, the resilient element is configured for compressing when moving from the rest to the deformed or loaded state of the resilient element which corresponds to the rest or loaded state of the mould/shroud coupling mechanism, respectively. This is referred to as a "compression-resilient element". The compression-resilient element is preferably a compressible spring, preferably a spiral spring (see FIG. 17B), a compressible hydraulic or pneumatic piston (see FIG. 17C), or a compressible elastomeric or generally viscoelastic element (see FIG. 17D).

Figure 17E:
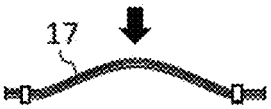

In a third embodiment shown in FIGS. 17E, the resilient member is configured for flexing when moving from the rest to the deformed state of the resilient element. This is referred to as a "flexural resilient element." The flexural resilient element can comprise a preferably curved blade or rod and is preferably made of steel or a fibre-reinforced composite material, attached at one point or at two points as illustrated in FIG. 17E.

Alternatively, the compliant element (17) comprises a free-flowing material enclosed in one or more bags or flexible containers configured for viscously deforming upon application of the load onto the seat member (15). The compliant element can also comprise disposable elements configured for being destroyed or crushed by plastic deformation upon application of the load on the funnel by the nozzle.

Preferably, the mould/shroud coupling mechanism (14) comprises at least three resilient elements, preferably at least three spiral springs (17*s*), extending between the seat member (15) and the base member (16), wherein the at least three resilient elements are preferably equally spaced apart around a circumference of the central holes of the seat member (15) and the base member (16), as illustrated in FIGS. 3, 4 and 5. Preferably, the at least three spiral springs which are preferably equally spaced apart extend between said seat member and said base member at the circumference thereof and with a distance to a lead-in for said hollow shaft of the shroud. This design has the advantage that the spiral springs will not be heated up excessively by the molten metal flowing through the shroud bore from the funnel to the hollow shaft of the shroud during the casting process.

Mould Assembly

In another aspect, the invention concerns a mould assembly comprising the mould (2) according to the invention as described supra, and the shroud (9) in the casting position, with the funnel resting on the seat member (15). The shroud comprises a funnel (11) attached to a proximal end of a shaft (10) which is hollow and has a distal end (10*d*) comprising a shroud outlet (9*o*). The shroud casting position is defined as the position wherein the shaft (10) is accommodated in the bore (7) with the distal end (10*d*) thereof inserted through the housing inlet (6*i*) with the shroud outlet (9*o*) enclosed in the housing (6).

Preferably, the funnel is located outside of the mould, i.e., above and adjacent to the upper surface (8) of the mould, and the shaft (10) is received within said bore (7) and is movable up and down therein. The shaft is elongated and extends along the vertical direction such that molten metal may flow through it driven by gravity. The shroud outlet (9*o*) may comprise one or more apertures for dispensing molten metal in the housing (6).

In the shroud casting position as shown in FIG. 5 the hollow shaft extends all the way through the bore (7) into the housing (6). Molten metal is supplied to the casting cavity (3) through a shroud line extending from the ladle to the casting cavities including the nozzle, the shroud, the housing, and the feeding channel (5). The shroud line is substantially air-tight and prevents re-oxidation of the metal by protecting it from the atmosphere. The hollow shaft (10) feeds the molten metal via the housing (6) and via the feeding channels (5) through inlets (4) into the casting cavity (3). The bore (7) which extends substantially perpendicular to the upper surface (8) of the mould (2) is sized to receive the shroud (9) such that there is substantially no gap therebetween while still allowing linear movement of the shroud (9) in the bore (7). In fluid communication with the casting cavity (3) is an open feeder sleeve (13), which extends between the casting cavity (3) and the upper surface (8) of the mould (2).

The shroud (9) is made of a refractory material, such as for example of fused silica. Alternatively, the shroud can be made of other materials like alumina-graphite materials. Preferably, the proximal end of the shroud (9) which forms the funnel (11) has a conical shape with sloping shoulders (23) which rest on the seat member (15). In one embodiment, the shoulder rests on a filling (22) filling up a space between a sleeve of the seat member (15) and the funnel as can be taken from the cross-sectional view in FIG. 4. Alternatively, the shoulder of the shroud rests directly on the seat element, as shown in FIGS. 9C, 9D, 12, and 13.

In a preferred embodiment of the mould assembly according to the invention, the shroud (9) is fixed to the seat member (15), preferably with a filling (22) of moulding sand sealing an annular gap between the funnel (11) and the seat member (15) and defining a seat for the funnel (11), and the seat member (15) preferably comprises a sleeve (21) defining a boundary of the annular gap as illustrated in FIG. 4.

In a preferred embodiment of the invention, a gasket is placed in the mouth of the funnel (11), allowing a basically tight engagement between the nozzle (12) and the funnel (11). The gasket may for example be formed by a plasticized clay or by an intumescent material.

Casting Installation

In another aspect, the invention concerns a casting installation comprising the mould (2) according to the invention, the shroud (9), and the ladle (103) comprising the nozzle (12) provided at a base of the ladle (103) for dispensing molten metal out of the ladle. The nozzle (12) is configured for reversibly and sealingly engaging into the funnel (11) of the shroud (9). The ladle (103) is configured for being displaced relative to the mould (2), such as to position the nozzle (12) substantially vertically above the mould/shroud coupling mechanism (14) and to be lowered vertically until the nozzle (12) is sealingly engaged in the funnel (11) of the shroud (9) in the shroud casting position by applying the load onto the seat member (15). The casting installation may comprise a gasket which is preferably located in the funnel. In the casting installation, the shroud (9) may be fixed to the seat member, preferably with the filling (22), or may be detachable and removable from the seat member (15).

As this also can be seen from FIG. 6, the nozzle of the ladle preferably has a semi-spherical shape, and the funnel (11) is correspondingly shaped. The funnel and the nozzle are preferably complementary in shape, e.g., forming mating spherical caps or otherwise curved surfaces, so that tilting of the ladle may be tolerated within certain limits. If the compliant elements (17) comprise a resilient element such as spiral springs, the reaction force of the compliant element also ensures that the nozzle (12) and the funnel (11) are kept in sealing engagement with each other during casting. The reaction force exerted by the compliant element ensures that the nozzle and the funnel are held in sealing engagement with each other while sufficient pressure on a sealing surface or on a gasket within the funnel is always held. The compliant element may also compensate any tilting or up and down vibrations of the ladle which might occur due to the fact that the centre of gravity of the ladle may change during casting i.e., while the ladle is emptied.

The funnel and the nozzle are preferably configured such that the nozzle is self-centering within the funnel. For example, a surface of the funnel configured for receiving the nozzle may have a conical shape as represented in FIGS. 3 and 4, such that when lowering down the ladle (103) vertically for engaging the nozzle into the funnel with the nozzle not being perfectly aligned with the funnel, the nozzle (12) can slide over the conically shaped surface and apply a force onto the seat member (15) to displace the seat member along the horizontal direction and restore the alignment between the nozzle and the funnel and ultimately the sealing engagement of the nozzle in the funnel.

Ladle/Shroud Coupling Mechanism (140)

A preferred embodiment of the casting installation according to the invention comprises a ladle/shroud coupling mechanism (140) configured for reversibly gripping the shroud (9) to the nozzle (12), preferably without forming a seal between the funnel (11) and the nozzle (12).

Figure 2:
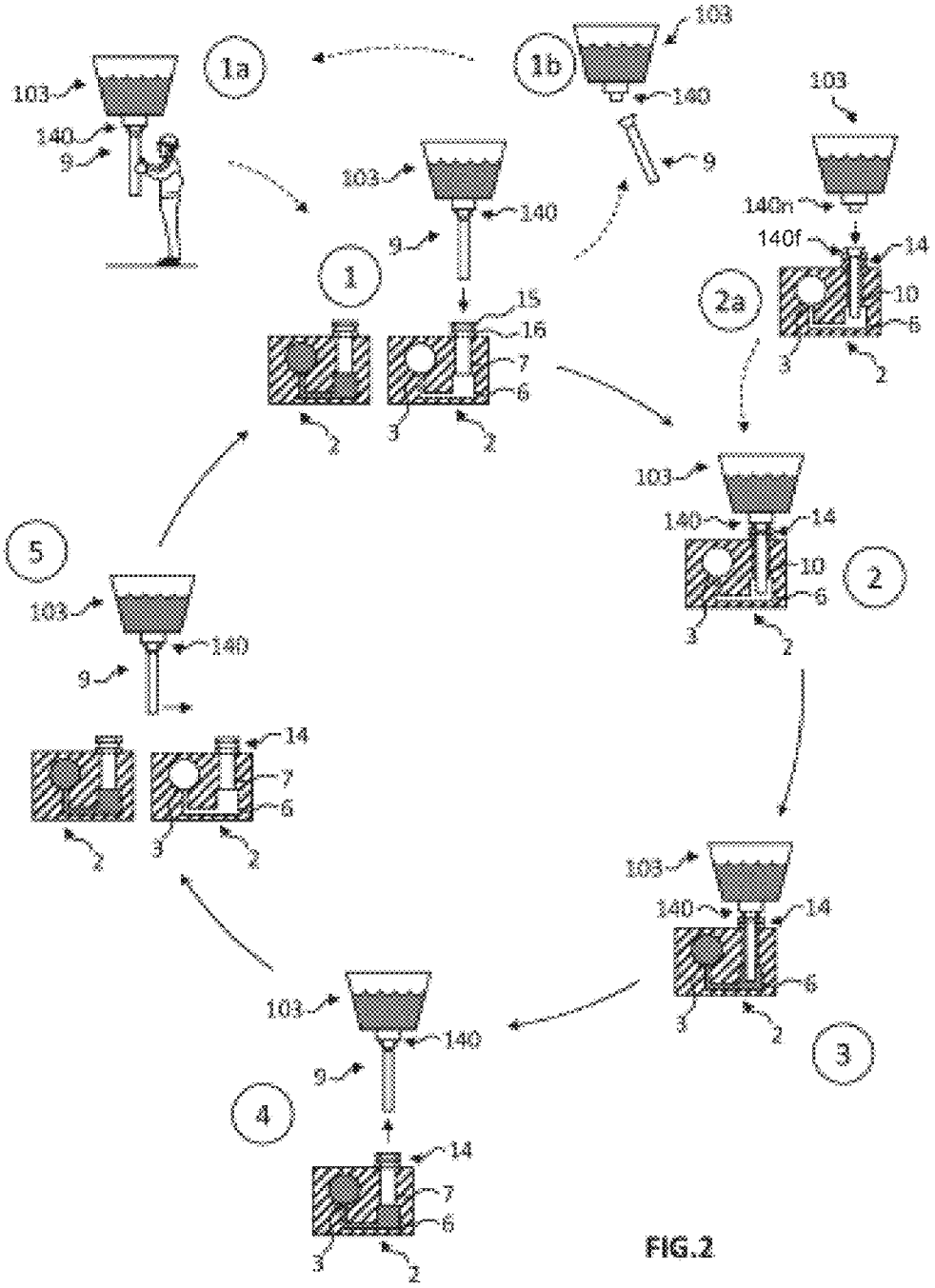
FIG. 2 shows steps of a metal casting method with the casting installation according to an alternative embodiment of the invention comprising the ladle/shroud coupling mechanism (140).
Figure 9A:
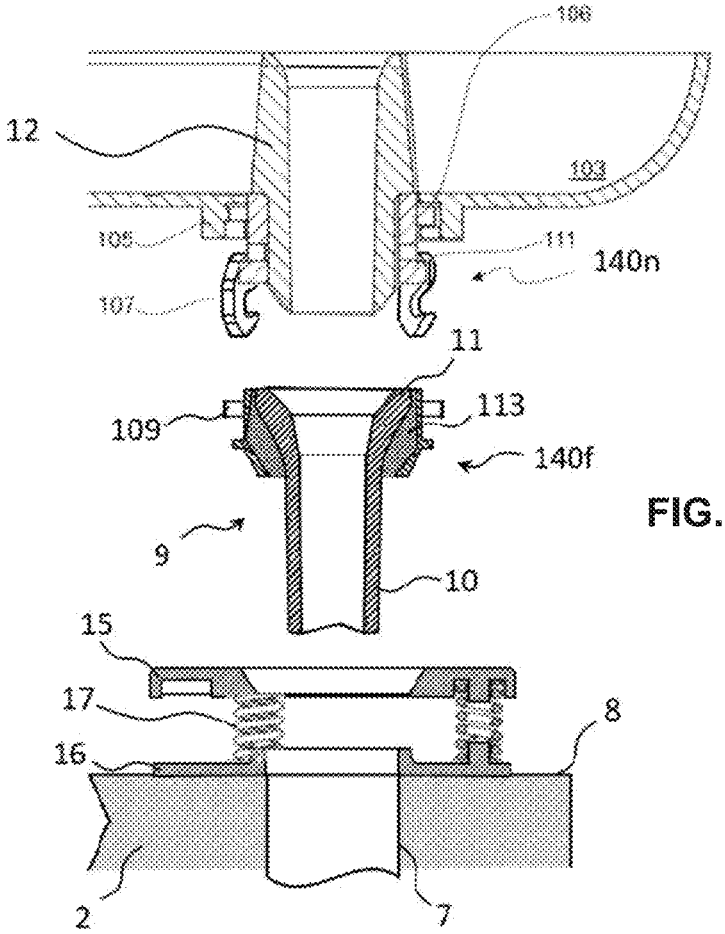
FIG. 9A show detailed cross-sectional views of the ladle/shroud coupling mechanism in the casting installation according to an embodiment of the invention, before gripping the shroud to the nozzle.

As illustrated in FIGS. 2 and 9A, this allows moving the ladle with the shroud suspended thereto, which is advantageous when the shroud can be reused for multiple castings in a row, e.g. This is illustrated in FIG. 2. When performing a series of subsequent castings with a same ladle and shroud (9), the shroud can for example be disengaged from the bore of a first mould after completing casting of metal in the first mould by lifting the ladle upward (see FIG. 2—step 4). Then, the ladle is translated horizontally for positioning the shroud above the bore of a second mould (see FIG. 2—step 5). Then, the ladle is lowered downward (see FIG. 2—step 1) until the shroud reaches the casting position (see FIG. 2—step 2) and a subsequent casting can be performed into the second mould. This operation can be repeated as long as the shroud is in casting conditions. After that, the spent shroud can be removed (see FIG. 2—step 1*b*) and a new shroud loaded to the ladle (see FIG. 2—step 1*a*). This ladle/shroud coupling mechanism allows a same shroud to be repeatedly used several times for multiple castings. It also saves operator workload as the coupling between the ladle, shroud, and mould can be performed by the operator commanding the ladle positioning system alone. Between two castings with a same shroud, the shroud heated by a previous casting in a mould does not need to be manipulated by an operator to position it in the casting position in the subsequent mould, thus increasing safety.

Figure 10:
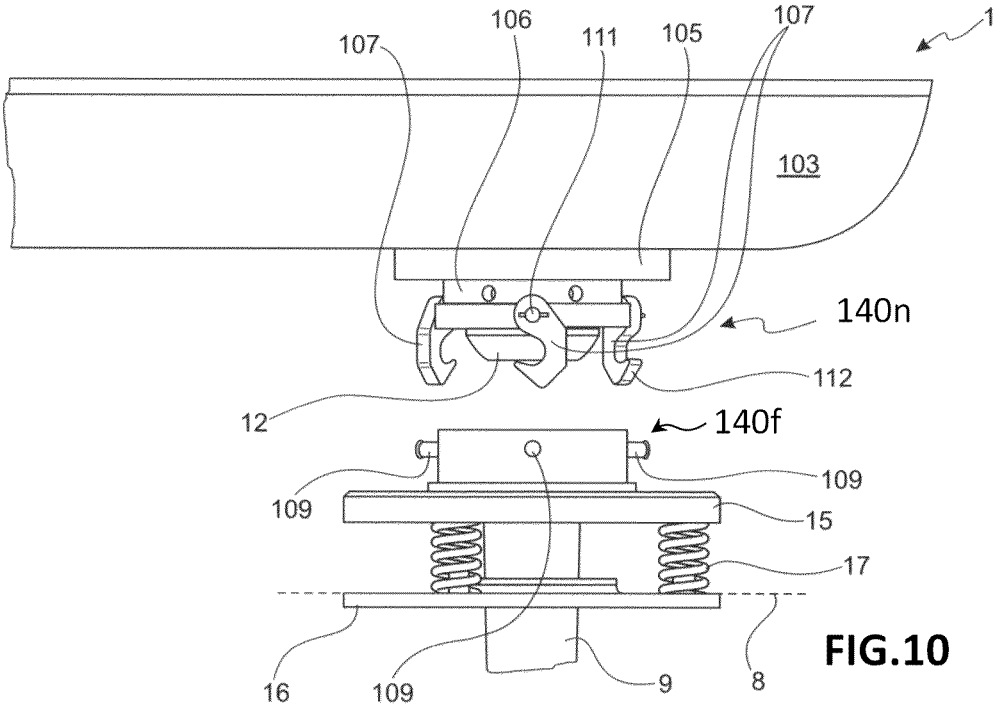
FIG. 10 shows a detailed view of the ladle/shroud coupling mechanism in the casting installation of FIG. 9A, before gripping the shroud in the shroud casting position to the nozzle.
Figure 11:
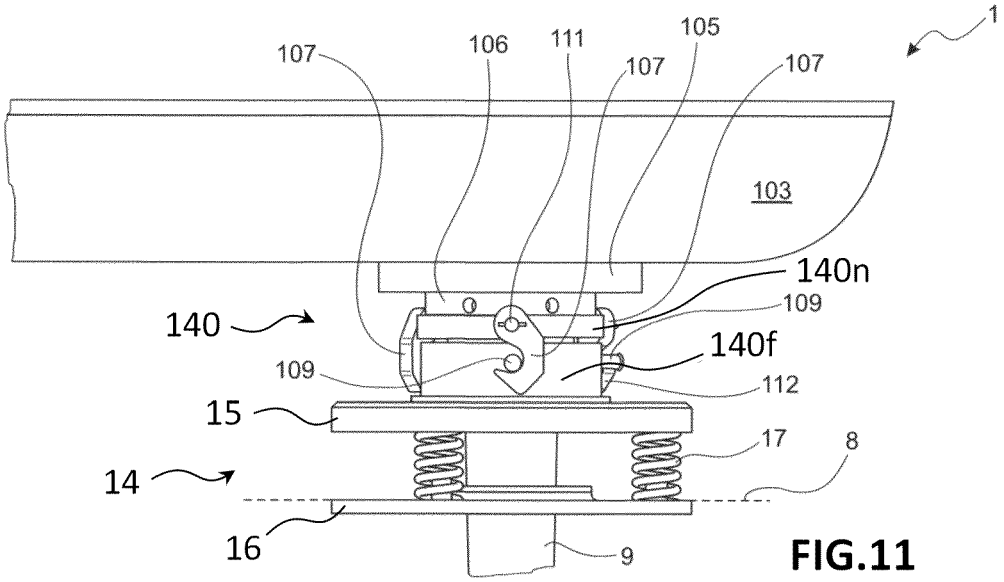
FIG. 11 shows a detailed view of the ladle/shroud coupling mechanism in the casting installation of FIG. 10, with the shroud gripped to the nozzle in the shroud casting position.

As shown in FIG. 9A, the ladle/shroud coupling mechanism (140) comprises a funnel adapter (140*f*) which is fixed to the funnel of the shroud (9) and comprises holding means. The funnel adapter (140*f*) is generally made of metal and is fixed to the shoulder of the shroud with an adhesive filling (113) such as a cement or the like. The ladle/shroud coupling mechanism (140) also comprises a nozzle adapter (140*n*) which is fixed to a base of the ladle (103) or to the nozzle (12) and is configured for engaging the holding means of the funnel adapter (140*f*) to reversibly lock the shroud (9) to the nozzle (12) in a locked position. The unlocked and locked positions of the ladle/shroud coupling mechanism (140) are represented in FIGS. 10 and 11, respectively. The base of the ladle is the lowest part of the ladle in use. The nozzle adapter (140*n*) is preferably mounted at the base of a bottom-pour-ladle.

The funnel adapter (140*f* and nozzle adapter (140*n*) are complementary to one another and are configured to releasably and loosely engage one another in the locked position. One important aspect of the ladle/shroud coupling mechanism (140) according to the invention is that the funnel adapter (140*f*) and nozzle adapter (140*n*) are configured to loosely engage one another in a locked position. That means that the funnel and nozzle adapters engage each other in the locked position with sufficient play relative to each other so that they can be articulated to a certain extent relative to one another within certain limits. This design allows for relative movement of the shroud and the ladle when the shroud is attached to the ladle so that the risk of damage for the shroud while being inserted for example into the bore of the mould is significantly reduced. In the locked position, it is preferred that no sealing contact is formed between the nozzle and the funnel.

Figure 14:
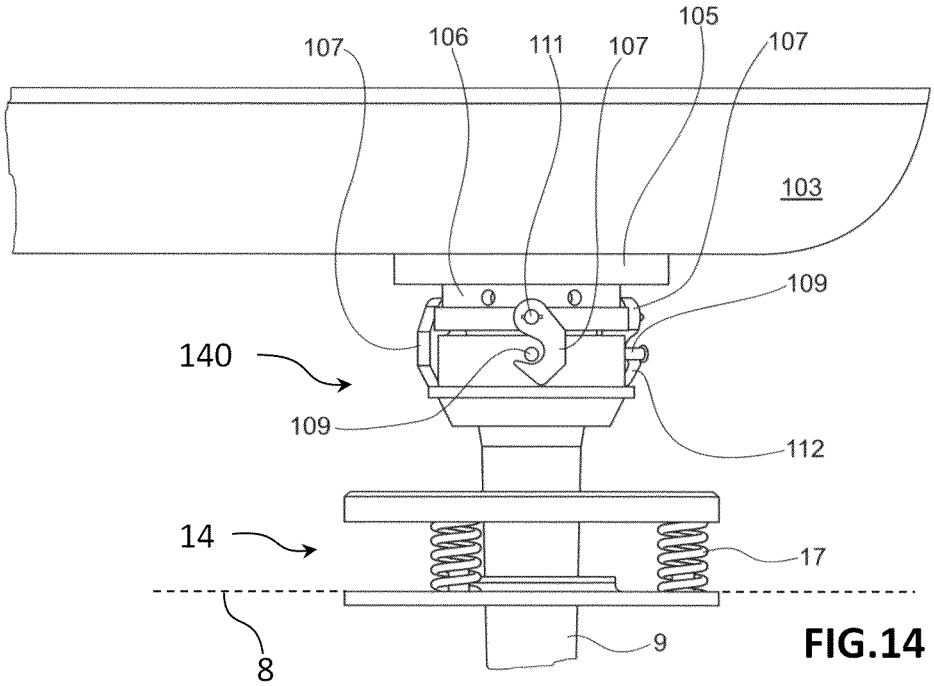
FIG. 14 shows a detailed view of the ladle/shroud coupling mechanism in the casting installation according to the invention, with the shroud coupled to the nozzle and vertically translating (up or down) the ladle and the shroud coupled thereto above the mould.

In a preferred embodiment of the ladle/shroud coupling mechanism represented in FIGS. 10 and 11, the holding means of the funnel adapter (140*f*) comprise holding pegs (109) and the nozzle adapter (140*n*) comprises fastening hooks (107) configured for reversibly engaging the holding pegs (109) and preferably configured to be self-engaging with the holding pegs (109). The self-engaging fastening hooks allow for gripping the shroud to the ladle easily. For example, this allows using the ladle to pick up a shroud held in the casting position in a first mould (2) according to the invention as illustrated in FIG. 10, by lowering the ladle so as to engage the holding means of the funnel adapter with the nozzle adapter as illustrated in FIGS. 11 and 15, and then lift the ladle to remove the shroud from the bore as illustrated in FIGS. 14 and 16.

Again, turning to FIG. 12, the funnel adapter (140*f*) can be a sleeve like element which has a truncated bearing surface (114) resting on a sloping edge (115) in a central hole (25) of the seat member (15) forming a seat for the funnel adapter (140*f*). The funnel adapter (1400 loosely sits in the seat member (15) and is only held by the force of gravity that is to say by the weight of the shroud (9) which is suspended to the funnel adapter (140*f*).

On the outer circumference of the funnel adapter (140*f*) three or four holding pegs (109) extend outwards in the radial direction. The holding pegs (109) may be engaged by fastening hooks (107) attached to the nozzle adapter (140*n*) which is attached to the ladle base plate (105).

The nozzle adapter (140*n*) is designed as a socket surrounding the nozzle (12). At the side attached to the ladle (103), also referred to as the proximal side, the first coupling member comprises a bayonet ring (106) engaging the ladle base plate (105). The nozzle adapter (140*n*) is detachably connected to the ladle (103). At the other end of the nozzle adapter (140*n*), also referred to as the distal end, the nozzle adapter (140*n*) comprises a plurality of studs (111) on which the fastening hooks (107) are rotatably attached.

While lowering the nozzle (12) into the funnel (11) the nozzle adapter (140*n*) and the funnel adapter (140*f*) are engaged with each other. Coupling and locking of the nozzle and funnel adapters can be achieved into different ways. The fastening hooks (107) can be self-engaging. A ramped surface (112) of the fastening hooks (107) slides over the holding pegs (109) so that the fastening hooks (107) catch the holding pegs (109).

Alternatively, the funnel adapter (140*f*) may be rotated so that upon lowering of the ladle (103) the holding pegs (109) are placed between the fastening hooks (107) and then upon rotation of the funnel adapter (140*f*), for instance counter clockwise locking of the holding pegs (109) within the fastening hooks (107) is achieved.

Figure 13:
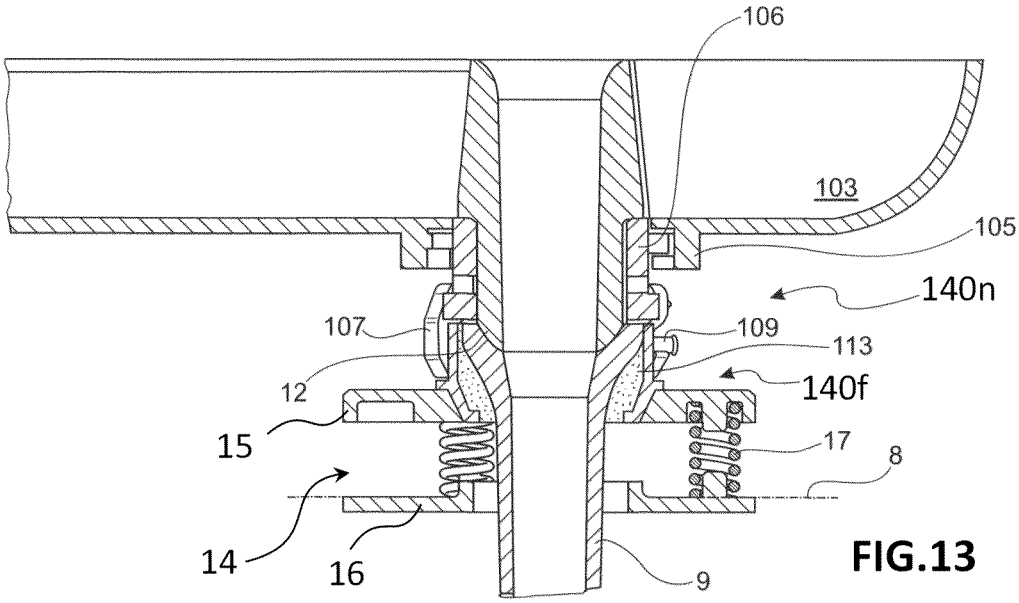
FIG. 13 shows a detailed cross-sectional view of the ladle/shroud coupling mechanism of FIG. 11.

Once coupled as shown in FIG. 13 the ladle (103) with the shroud (9) hanging on the ladle can be lifted up for being inserted in a second mould for second casting with the same shroud.

In another embodiment of the ladle/shroud coupling mechanism (140), the holding means of the funnel adapter (140*f*) comprises one or more holding pegs (109) and the nozzle adapter (140*n*) comprises a bayonet coupling element configured for interacting with the one or more holding pegs to reversibly lock the shroud (9) to the nozzle (12) in the locked position.

Figure 12:
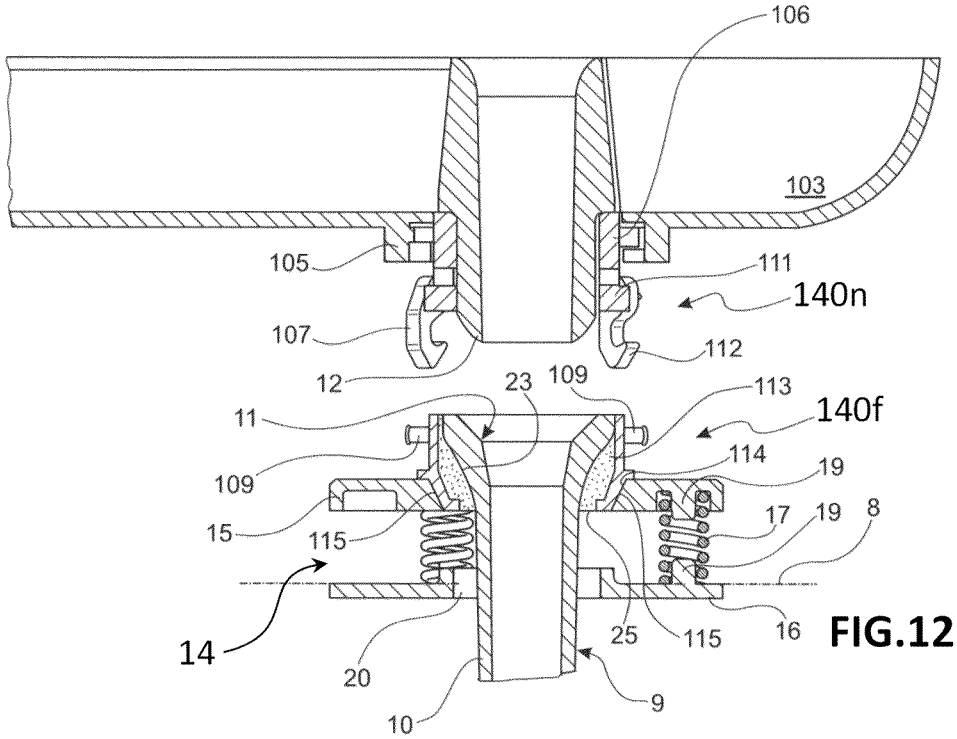
FIG. 12 shows a detailed cross-sectional view of the ladle/shroud coupling mechanism of FIG. 10.

The nozzle adapter (140*n*) might be in the form of a sleeve like member which at one end and/or at both ends may be configured as a bayonet coupling element. The nozzle adapter (140*n*) may enclose the nozzle and may be releasably attached to a ladle baseplate (105) as illustrated in FIGS. 12 and 13. For example, at one end the nozzle adapter (140*n*) can be configured as a bayonet ring (106) engaging a corresponding structure at the ladle baseplate.

In a particularly preferred embodiment of the ladle/shroud coupling mechanism according to the invention the funnel adapter and/or the nozzle adapter are rotatable around a longitudinal axis in order to allow at least disengagement of the funnel and nozzle adapters by rotating either the funnel or the nozzle adapter around said longitudinal axis.

In the casting installation according to the invention, the seat member (15) of the mould/shroud coupling mechanism (14) is configured for receiving the funnel adapter (140*f*) and holding the shroud (9) in the shroud casting position.

The funnel adapter (140*f*) is preferably fixed to the shroud (9) with an adhesive material (113) as represented in FIGS. 12 and 13. Preferably, the proximal end of the shroud in the area of the funnel may have the shape of a truncated cone the shoulders (23) of which are held in the adhesive material (113) which is preferably a filling or packing of moulding sand of the funnel adapter which for example may comprise an organic binder. The funnel adapter may be designed as a sleeve like element. The funnel adapter preferably surrounds the adhesive material (113).

The funnel adapter (140*f*) may be configured to be received in the seat member (15) on the mould (2) in a centred fashion. Therefore, the funnel-adaptor may comprise a truncated bearing surface.

Preferably, the casting installation according to the invention allows coupling of the ladle with the shroud in situ, i.e., while the shroud is inserted in the mould. A separate attachment stand for the ladle is thus not required. This system allows inserting the shroud into the mould with a separate crane. Once the shroud is inserted in the mould the ladle may be located above the mould with the nozzle being centred over the funnel of the shroud. Upon lowering the ladle, the nozzle may be brought into engagement with the funnel of the shroud. While engaging the nozzle of the ladle with the funnel, the funnel and shroud adapters may be locked with one another so that the ladle and the shroud are loosely locked to one another.

A person skilled in the art will appreciate that the downward directed force upon lowering the nozzle of the ladle into the funnel will cause the seat member to move towards the base member against the reaction force of the compliant element, preferably against the spring tension of the at least one spring, so that the coupling of the nozzle and the funnel can be performed in a controlled fashion. The downward movement of the seat member towards the base member will of course cause the shroud to move axially within the bore of the mould. For example, if the distal end of the shroud extends into a housing of the mould, the downward movement of the seat member towards the base member drives the distal end of the shroud deeper into the housing where the at least one shroud outlet (9*o*) communicates with the runner system of the mould i.e., with the casting cavity via the feeding channels (5).

In the existing art, the so-called Harrison process suggested by the Harrison Steel Castings Company involves attaching a fused silica shroud below the nozzle of a bottom pour ladle. The mould is provided with a side riser for receiving the shroud. Below the side riser a pouring well is provided which feeds into the casting cavity. With the shroud attached, the ladle is aligned over a mould and then lowered so as to insert the shroud into the side riser. The stopper rod is then moved into the open position so that molten metal with the ladle flows through the nozzle and the shroud into the mould. Once the mould is filled, the stopper is closed. The ladle is lifted until the shroud is clear of the mould and is then moved over to the next mould to repeat the process. For attaching the shroud below the nozzle of the bottom-pour-ladle, the ladle is first secured in an attachment stand and then the shroud is fixedly attached to a shroud holder assembly which is connected to the ladle baseplate.

One drawback of said rigid and fixed attachment of the shroud to the nozzle is that clearing the nozzle by oxygen lancing is almost impossible. As the material of choice for the shroud is fused silica, inserting the shroud into the side riser of the mould while being attached to the bottom of the ladle is a difficult and critical manoeuvre since even the slightest tilting of the shroud may result in destruction of the shroud.

In the invention, the previous drawback is avoided by loosely gripping the shroud to the ladle and by providing the compliant element allowing relative displacements between the seat and base members of the mould/shroud coupling mechanism (14). This reduces the risk of destroying the shroud when inserting it into the mould and thus provides a safer system for handling a shroud in order to obtain several castings with one shroud in one pouring heat.

To further improve the safety of the engagement of the shroud gripped to the ladle in the bore of the mould, the seat member (15) preferably comprises a conical portion centred on the central hole of the seat member, the conical portion being configured for guiding the shroud in alignment with the bore (7) as the ladle (103) is lowered vertically with the shroud (9) reversibly locked to the nozzle (12).

Method without Ladle/Shroud Coupling Mechanism (140)

The invention also concerns a method for casting a molten metal with the casting installation according to the invention.

In a first embodiment of the method illustrated in FIG. 1, the casting installation does not comprise the ladle/shroud coupling mechanism (140) and the shroud is inserted into the bore (7) in the casting position before the ladle approaches the mould. As represented at step 1*a* of FIG. 1, the casting installation is provided including the mould (2) and the shroud (9) inserted therein to reach the casting position. Preferably, the axis of symmetry of the bore of the mould is vertical when the mould is installed for use, and the shroud is installed in the bore by translating it along the vertical direction. The shroud (9) can be inserted in the mould (2) by an operator as illustrated in FIG. 1 (1*a*) or using one or more dedicated appliances or a robot. As illustrated in FIG. 5, the shaft (10) is inserted in the bore (7) of the mould up to the shroud is installed in the casting position defined as the shaft (10) being accommodated in the bore (7) with the distal end (10*d*) thereof inserted through the housing inlet (6*i*) with the shroud outlet (9*o*) enclosed in the housing (6). In the shroud casting position, a longitudinal axis of the hollow shaft (10) is preferably vertical. The shroud (9) is held in the shroud casting position by the seat member (15) which the funnel (11) rests on.

In an example of the invention, the funnel of the shroud comprises a shoulder for seating the funnel onto the seat member (15), and the funnel is accommodated directly to the seat member (15) and the shroud is releasably maintained in the shroud casting position under the force of gravity. In another example, a filling (22) is provided between the funnel and the seat member (15). The shroud (9) is fixed to the seat member (15) with a filling (22) sealing an annular gap between the funnel (11) and the seat member (15) and defining a seat for the funnel (11). Preferably, the seat member (15) comprises a sleeve (21) defining a boundary of the annular gap, and the filling (22) can be applied on the sleeve (21) prior to receiving and seating the funnel on the filling (22). Then, the filling should dry until the funnel is fixed to the seat member (15).

After step 1*a* in FIG. 1, the mould assembly is ready for receiving the molten metal. As illustrated in step 1 of FIG. 1 and in the detailed view of FIG. 7A, a ladle (103) loaded with molten metal is brought above a first mould loaded with a shroud, for example with a crane and until the nozzle at the base of the ladle is vertically aligned with the mould/shroud coupling mechanism (14) and with the bore (7). The ladle (103) is then lowered until the nozzle (12) engages the funnel of the shroud (9) as illustrated in FIG. 7B. Before contacting and applying a load onto the funnel with the nozzle, the mould/shroud coupling mechanism (14) and the compliant element are in a rest state wherein the seat and base members are separated by the rest distance h0 measured along the vertical direction.

Then, the method comprises the step of further lowering the ladle (103) vertically until the nozzle (12) engaged in the funnel (11) applies a load onto the funnel sitting on the seat member (15), thus moving the seat member (15) relative to the base member (16) against the compliant elements (17), and forming a sealing contact between the nozzle (12) and the shroud (9) which is in the shroud casting position. This is illustrated in step 2 of FIG. 1 and in the detailed view of FIG. 7C, wherein the mould/shroud coupling mechanism (14) and the compliant element are in a loaded state wherein the seat and base members are separated by the sealed distance h1<h0 measured along the vertical direction.

After establishing the sealing contact between the nozzle (12) and the funnel (11), casting of the molten metal can start. The nozzle is opened, thereby allowing the molten metal to flow from the ladle (103) to the casting cavity (3) through the nozzle (12), the shroud (9), and the housing (6) of the first mould. Once the casting cavity is full as illustrated in step 3 of FIG. 1, the nozzle can be closed to stop the flow of molten metal.

As illustrated in step 4 of FIG. 1, after finishing the casting the ladle is lifted vertically for disengaging the nozzle from the funnel of the shroud, thus removing the load from the nozzle on the seat member (15). The shroud is not gripped to the ladle and remains inserted in the first mould with the funnel held by the seat member and the shaft accommodated in the bore (7). If the compliant element comprises no resilient element, the mould/shroud coupling mechanism (14) and the compliant element remain in the loaded state and the shroud does not move upon lifting the ladle. If the compliant element comprises a resilient element, the mould/shroud coupling mechanism (14) and the compliant element may return at least partially to the rest state upon lifting the ladle, and the shroud held by the seat member may correspondingly slide upward within the bore.

Then, the ladle is available for a subsequent casting into a second mould, preferably another pouring with the same heat as illustrated in FIG. 1—step 5 wherein the ladle is translated horizontally above a second mould for performing a next casting according to the present method according to the invention wherein the ladle does not comprise the ladle/shroud coupling mechanism (140).

Method with Ladle/Shroud Coupling Mechanism (140)

In a second embodiment of the method according to the invention, the casting installation comprises the ladle/shroud coupling mechanism (140). Such method is illustrated in FIG. 2. For the casting, a first and second moulds (2), a shroud (9) with the funnel adapter (140*f*) fixed thereto, and a ladle with the nozzle adapter (140*n*) fixed to the base or to the nozzle thereof are provided. There are at least two ways of initializing casting with the casting installation comprising the ladle/shroud coupling mechanism (140).

In a first way of initializing the casting illustrated in FIG. 2—step 1*a*, the shroud is gripped to the ladle prior to inserting the shroud into the first mould. For example, this can be carried out by an operator lifting the shroud towards the base of the ladle for engaging the funnel (11) of the shroud (9) over the nozzle (12) and gripping the shroud (9) to the nozzle (12) with the ladle/shroud coupling mechanism (140) by engaging:

- the holding means of the funnel adapter (140*f*) fixed to the funnel of the shroud (9) with,
- the nozzle adapter (140*n*) fixed to the base of the ladle (103) or to the nozzle (12), such as to lock the shroud (9) to the nozzle (12) in a locked position.

Alternatively, the ladle can be displaced above a storage place of the shroud (9) and pick it up by lowering the ladle with the nozzle vertically aligned with the funnel until engaging the nozzle in the funnel and gripping the shroud (9) to the nozzle (12) with the ladle/shroud coupling mechanism (140).

Figure 9B:
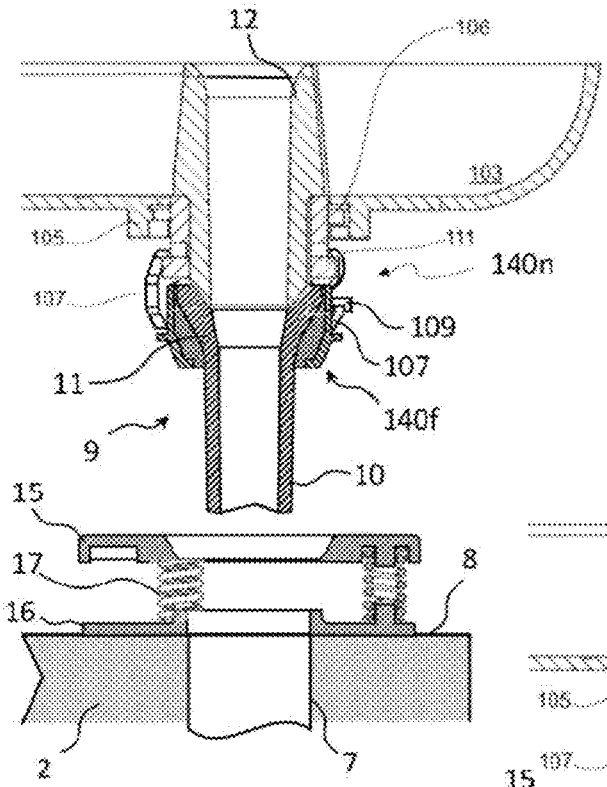
FIG. 9B shows a detailed cross-sectional view of the ladle/shroud coupling mechanism in the casting installation of FIG. 9A, with the shroud coupled, albeit not sealed to the nozzle and holding the shroud vertically above the mould/shroud coupling mechanism.
Figure 9C:
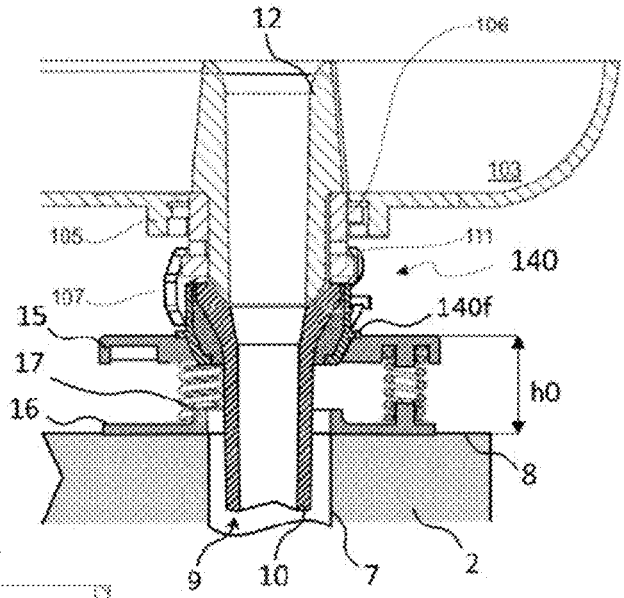
FIG. 9C shows a detailed cross-sectional view of the ladle/shroud and mould/shroud coupling mechanism in the casting installation of FIG. 9A, wherein the funnel adapter is received in the seat member of the mould/shroud coupling mechanism holding the shroud, and wherein the compliant element is in a rest state.
Figure 9D:
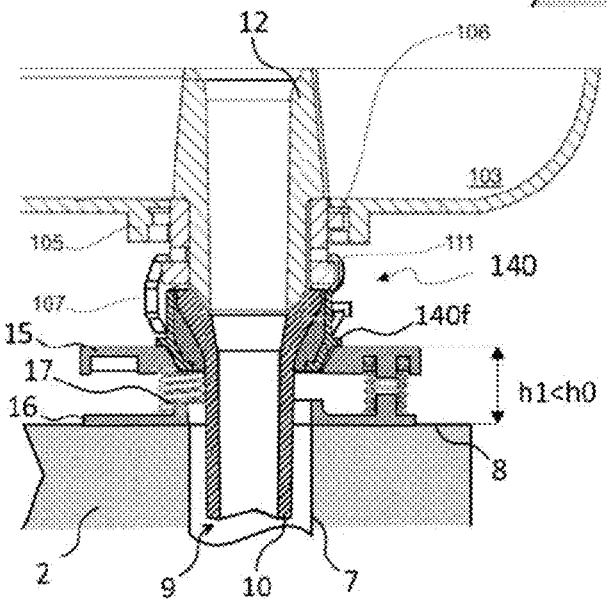
FIG. 9D shows a detailed cross-sectional view of the ladle/shroud and mould/shroud coupling mechanism in the casting installation of FIG. 9A, wherein the ladle is further lowered vertically with the shroud gripped to the nozzle until the nozzle applies a load onto compliant members, thus forming a sealing contact between the nozzle and the shroud.

Once the shroud is gripped to the ladle, the ladle can be moved for:

- positioning the shroud (9) locked to the nozzle (12) substantially vertically above the mould/shroud coupling mechanism (14) as illustrated in step 1 of FIG. 2 and in FIG. 9B, and then
- lowering the ladle vertically until the shroud (9) reaches the shroud casting position with the funnel (11) resting on the seat member (15) as illustrated in FIG. 9C and FIG. 2—step 2.

Preferably, the funnel rests on the seat member (15) through the funnel adapter (1400 i.e., the funnel adapter (140*f*) is fixed to the funnel and is received in the seat member (15) of the mould/shroud coupling mechanism (14), as illustrated in FIG. 9C wherein a conical portion of the seat member (15) is configured for mating with a corresponding conical portion of the funnel adapter (140*f*).

The sealing contact between the nozzle (12) and the shroud (9) in the shroud casting position is formed by further lowering the ladle (103) vertically until the nozzle (12) engaged in the funnel (11) applies a load onto the funnel sitting on the seat member (15), thus moving the seat member (15) relative to the base member (16) against the compliant elements (17). This is illustrated in step 2 of FIG. 2 and in FIG. 9D.

In a second way of initializing the casting, the shroud (9) is inserted in the first mould in the casting position before being gripped by the ladle. The gripping of the shroud occurs by lowering the nozzle towards the funnel and a sealing contact is formed upon driving the nozzle further down against the resistance offered by the compliant element (17), as illustrated in FIGS. 2 (2*a*)&(2), 10 and 12.

Preferably, before a sealing contact is formed, the ladle and the shroud are not only releasably, but also loosely locked with each other.

In the second way of initializing the casting illustrated in FIG. 2—step 2*a*, the sealing contact between the nozzle (12) and the shroud (9) in the shroud casting position is formed after gripping the shroud to the ladle. This is achieved by further lowering the ladle (103) vertically until the nozzle (12) engaged in the funnel (11) applies a load onto the funnel sitting on the seat member (15), thus moving the seat member (15) relative to the base member (16) against the compliant elements (17) as illustrated in step 2 of FIG. 2 and in FIG. 9D.

After establishing the sealing contact between the nozzle (12) and the funnel (11) according to the first or second way of initializing the casting, the nozzle is opened, thereby allowing the molten metal to flow from the ladle (103) to the casting cavity (3) through the nozzle (12), the shroud (9), and the housing (6) of the first mould. Once the casting is finished or the casting cavity is full as illustrated in step 3 of FIG. 2, the nozzle can be closed to stop the flow of molten metal.

As illustrated in step 4 of FIG. 2, upon finishing the casting the ladle with the shroud gripped thereto are lifted vertically and the shroud disengages from the first mould, and the load from the nozzle onto the seat member (15) is removed.

Then, the ladle with the shroud coupled thereto is available for a subsequent casting into a second mould with the same heat as illustrated in step 5 of FIG. 2 wherein the ladle is translated horizontally above the second mould for performing a next casting according to the present method wherein the ladle comprises the ladle/shroud coupling mechanism (140). Alternatively, at the end of a series of castings or if the shroud is degraded, no subsequent casting is performed, and the ladle is transported with the shroud gripped thereto in a disassembling location of the facility wherein it is separated from the ladle. The shroud (9) and the nozzle (12) are unlocked by disengaging the holding means of the funnel adapter (140*f*) from the nozzle adapter (140*n*), and the funnel and the funnel adapter (140*f*) are preferably detached such that the funnel adapter (140*f*) can be later reused and fixed to other shrouds. A new shroud can be used for continuing the casting in a series of new moulds.

LIST OF REFERENCE NUMERALS

1 Casting installation
2 Mould
2*a* Upper part of the mould
2*b* Lower part of the mould
3 Casting cavity
4 Cavity inlet
5 Feeding channels
6 Housing
6*i* Housing inlet

6*o* Housing outlet
7 Bore
8 Upper surface of the mould
9 Shroud
9*o* Shroud outlet
10 Shaft of the shroud
11 Funnel
12 Nozzle
13 Feeder sleeve
14 Mould/shroud coupling mechanism
15 Seat member
16 Base member
17 Compliant element
17*s* Spiral spring
18 Arms
19 Centring pins
20 Central hole in the base member
21 Sleeve
22 Filling
23 Shoulder
103 Ladle
105 Ladle baseplate
106 Bayonet ring
107 Fastening hooks
109 Holding pegs
111 Studs
112 Ramped surfaces
113 Adhesive material
114 Bearing surface
115 Sloping edge
140*f* Funnel adapter
140*n* Nozzle adapter

The invention claimed is:

1. A mould (2) for casting molten metals, comprising:

a casting cavity (3) having a cavity inlet (4), a housing (6) selected among a filter housing and a diverter housing, the housing (6) having a housing outlet (60) in fluid communication with the cavity inlet (4) and a housing inlet (6*i*) in fluid communication with:

a bore (7) extending between an upper surface (8) of the mould and the housing inlet (6*i*), a mould/shroud coupling mechanism (14) configured for accommodating a shroud (9) of a casting installation (1) in a shroud casting position, wherein the shroud comprises a funnel (11) attached to a proximal end of a shaft (10) which is hollow and having a distal end (10*d*) comprising a shroud outlet (90), and wherein the shroud casting position is defined as the shaft (10) being accommodated in the bore (7) with the distal end (10*d*) thereof inserted through the housing inlet (6*i*) with the shroud outlet (90) enclosed in the housing (6), characterized in that, the mould/shroud coupling mechanism (14) comprises:

a base member (16) fixed to the upper surface (8), a seat member (15) configured for receiving the funnel (11) and holding the shroud (9) in the shroud casting position, and in that, the seat member (15) is coupled to the base member (16) by at least one compliant element (17) such that the seat member (15) is separated from and movable relative to the base member (16) upon application of a load onto the seat member (15) which deforms the at least one compliant element (17), wherein the at least one compliant element (17) comprises one or more resilient elements including a spring extending between the seat member (15) and the base member (16) said (16), the at least one compliant element (17) compressing only under forces exerted by the seat member (15), the mould/shroud coupling mechanism (14), and the nozzle (12) of a ladle (103).

2. The mould (2) according to claim 1, wherein the base member (16) and the seat member (15) each comprises a central hole aligned with one another to define a lead-in towards the bore (7) for the shroud (9), and wherein the mould/shroud coupling mechanism (14) comprises at least three resilient elements, extending between the seat member (15) and the base member (16).

3. The mould (2) according to claim 2, wherein the at least three resilient elements are at least three spiral springs (17*s*).

4. The mould (2) according to claim 2, wherein the at least three resilient elements are equally spaced apart around a circumference of each central hole of the seat member (15) and the base member (16).

* * * * *